US005458273A

United States Patent [19]

Schubert et al.

[11] Patent Number: 5,458,273

[45] Date of Patent: Oct. 17, 1995

[54] MAILER ASSEMBLY

[75] Inventors: Lawrence J. Schubert, Kettering; Hugh B. Skees; Thomas J. Smith, both of Dayton, all of Ohio

[73] Assignee: The Standard Register Company, Dayton, Ohio

[21] Appl. No.: 932,719

[22] Filed: Aug. 19, 1992

[51] Int. Cl.[6] ..... B65D 27/04; B65D 27/06; B65D 27/34

[52] U.S. Cl. ..... 229/304; 229/69; 229/92.3

[58] Field of Search ..... 229/92.1, 92.3, 229/69, 304, 305, 306

[56] References Cited

U.S. PATENT DOCUMENTS

| | | | |
|---|---|---|---|
| 2,759,658 | 8/1956 | Sawdon | 229/305 |
| 3,325,188 | 6/1967 | Hiersteiner | 229/69 |
| 3,339,827 | 9/1967 | Steidinger . | |
| 3,411,699 | 11/1968 | Pine et al. . | |
| 3,419,286 | 12/1968 | Noonan et al. | 229/69 |
| 3,482,780 | 12/1969 | Johnsen . | |
| 3,507,519 | 4/1970 | McNabb | 229/69 |
| 3,908,892 | 9/1975 | Pelzer | 229/305 |
| 3,952,942 | 4/1976 | O'Leary et al. | 229/305 |
| 4,050,582 | 9/1977 | Kalve . | |
| 4,102,489 | 7/1978 | Lucas | 229/92.3 |
| 4,273,362 | 6/1981 | Carrier | 229/83 |
| 4,346,916 | 8/1982 | Shelton . | |
| 4,380,315 | 4/1983 | Steidinger | 229/69 |
| 4,915,287 | 4/1990 | Volk et al. . | |
| 5,092,514 | 3/1992 | Van Malderghem et al. . | |

FOREIGN PATENT DOCUMENTS

| | | | |
|---|---|---|---|
| 513176 | 11/1980 | Australia . | |
| 794357 | 2/1936 | France | 229/92.1 |
| 1502067 | 11/1967 | France . | |
| 2431964 | 2/1980 | France . | |
| 55-88941 | 6/1980 | Japan . | |
| 670451 | 12/1968 | Netherlands . | |
| 498748 | 1/1939 | United Kingdom | 229/92.1 |
| 809953 | 3/1959 | United Kingdom . | |
| 1564423 | 4/1980 | United Kingdom . | |

*Primary Examiner*—Stephen P. Garbe

*Attorney, Agent, or Firm*—Killworth, Gottman, Hagan & Schaeff

[57] ABSTRACT

A mailer assembly which can be supplied to a user in intermediate form and which, when assembled and sealed, has an enhanced ability to shield confidential information from unauthorized view is provided. The mailer assembly may also include an integral return envelope and also may be designed so that variable information can be printed on the sheets making up the mailer prior to assembly using nonimpact printers such as laser printers which use heat and pressure to fuse toner to paper. The mailer assembly includes first and second sheets in superimposed relation, with each of the first and second sheets having a pair of marginal side edges and a pair of end edges. The mailer further includes removable marginal side and end strips for opening the mailer. The first and second sheets are secured together parallel to their respective marginal side and end edges to form a subassembly. The subassembly is V-folded along a suitable axis thereof and secured together along its marginal and end strips to form the mailer assembly.

2 Claims, 6 Drawing Sheets

MAILER ASSEMBLY

BACKGROUND OF THE INVENTION

The present invention relates to a mailer assembly and to the individual parts of the mailer which may be provided in intermediate form to an end user for final printing and assembly.

Many types of confidential information are transmitted through the mails in the form of messages, invoices, notices of bank account balances and/or interest income for tax purposes, and the like. Further, documents of value such as automobile titles and registrations, checks, money orders, other negotiable instruments, and the like are also transmitted through the mails. Previously, where it was desired that the information or the nature of the document itself was to remain hidden until received by the addressee, envelopes were used. However, the labor and additional expense of using envelopes to transmit such documents has led to the increasing use of post cards or sealed mailers. Such post cards or mailers may be preprinted with nonvariable information and then supplied to a customer who can apply variable information (such as dollar amounts, names, addresses, and the like) with his own automated printing equipment.

Post cards are useful for delivering short messages, are less expensive to mail, and are relatively simple to be printed on by automated equipment. However, post cards have not been suitable in the past for the delivery of confidential information because the printed message was easily read by persons other than the addressee.

Sealed mailers provide a greater degree of confidentiality because a cover sheet may be positioned over the confidential matter. However, such products have had drawbacks because of the ability of an unauthorized observer to "see through" the mailer by holding it up to a light source to discern confidential information printed on interior surfaces of the mailer. Also, some confidential documents (such as checks) of necessity require back printing which will be exposed when the confidential document forms the bottom sheet of a sealed mailer. Thus, for example, the appearance of an endorsement area with accompanying language on the back of a mailer immediately alerts one to the fact that the mailer contains a check or other negotiable instrument.

For some mailers, it is also desirable that the mailer construction include a provision for a return envelope so that the recipient can, for example, pay a bill by placing a check in a pre-addressed return envelope. While mailers which include return envelopes are commercially available, their construction complicates the manufacture and assembly of the mailers and may prevent the end user from easily applying variable information to the contents of the mailer.

Further, there has been an ever increasing use of nonimpact printers such as laser printers by users of mailers to apply variable information to the mailers. As most typical mailers include patterns of heat sealable adhesive on one or more surfaces thereof, such mailers cannot pass through the heated fuser rolls of a laser printer without being activated and causing jams in the printer.

Accordingly, the need still exists in the art for a mailer which has enhanced ability to shield confidential information from unauthorized view while still providing the issuer of the mailer the convenience and cost savings of using a mailer produced by automated equipment. There also remains a need for a mailer which can be manufactured and assembled simply to provide an integral return envelope as a part of the mailer. Yet further, there is a need in the art for a mailer construction which can be passed through a laser printer and yet still have a capability of being sealed after variable printed information has been applied.

SUMMARY OF THE INVENTION

The present invention meets those needs by providing a mailer assembly which can be provided to a user in intermediate form and which, when assembled and sealed, has an enhanced ability to shield confidential information from unauthorized view. The mailer assembly may also include an integral return envelope and also may be designed so that variable information can be printed on the sheets making up the mailer prior to assembly using nonimpact printers such as laser printers which use heat and/or pressure to fuse toner to paper.

In accordance with one aspect of the present invention, a mailer assembly is provided which comprises first and second sheets in superimposed relation, with each of the first and second sheets having a pair of marginal side edges and a pair of end edges. The mailer assembly further includes removable marginal side and end strips for easy opening of the mailer. The first and second sheets may be temporarily secured together along their respective marginal side strips to form a subassembly. The subassembly is V-folded along a suitable axis thereof and more permanently secured together along its marginal side and end strips to form the finished mailer assembly. Typically, the most common configuration for the folded mailer subassembly will be one in which the subassembly is folded in half along a transverse axis.

The marginal side and end strips of the first and second sheets and the subassembly are preferably secured together with a heat sealable adhesive, although other types of adhesives may be used. It is preferred that in sealing the mailer the sheets be placed in superimposed relation, their marginal side strips temporarily secured, if needed, the sheets then V-folded, and the sheet assembly and folded subassembly sealed in a single step. To permit the recipient of the mailer to gain easy access to the information or document contained therein, the transverse and longitudinal lines of perforations are positioned inwardly of the secured end and marginal side strips of the subassembly, respectively, to form the removable marginal side and end strips.

In one embodiment of the invention, addressee information printed on an interior surface of the second sheet of the mailer can be viewed through a cut-out window area on the first sheet. The window can be placed in any convenient location on the first sheet. A transparent patch may be secured over the cut-out window area. Information, confidential or otherwise, may be printed on at least one interior surface of the first or second sheets. Due to the unique folded and sealed configuration of the mailer assembly of the present invention, the multiple overlapping plies of the mailer shield any confidential information from unauthorized view, yet provide ready access to that information by the recipient. To enhance the security of the confidential information, the second sheet of the mailer assembly may be safety paper.

In another embodiment of the invention, a mailer assembly including an integral return envelope is provided and includes first and second sheets in superimposed relation, with each of the first and second sheets having a pair of removable marginal side strips and a pair of removable end strips. Each of the first and second sheets includes a first portion and a second portion. Depending upon how the final mailer is configured, these portions typically will be defined by the location of the V-fold and will comprise the top and bottom halves of the respective sheets, or the left and right sides of the sheets.

The respective first portions of the first and second sheets are secured together parallel to their respective marginal side and end edges outwardly of the lines of perforations defining the removable marginal side and end strips for easy removal by a recipient. The respective second portions of the first and second sheets are secured together parallel to at least one marginal side edge and at least one end edge inwardly of the lines of perforations defining the removable marginal side and end strips with the secured together first and second sheets forming a subassembly, and the secured together second portions of the first and second sheets forming an integral return envelope. The subassembly is V-folded and secured together parallel to its marginal side and end edges to form the finished mailer assembly.

The marginal side and end strips of the first and second sheets and the subassembly are secured together preferably with a heat sealable adhesive. As with the previously described embodiment of the invention, a cut-out window area may be provided on the first sheet with an optional transparent patch secured over the cut-out window area. For this particular embodiment, preprinted return address information may be provided on the exterior surface of the second sheet which forms one exterior surface of the integral return envelope.

In one configuration of the mailer, the respective second portions of the first and second sheets are secured together along both marginal side strips and an end strip inwardly of the perforations defining the removable marginal side and end strips to form an integral return envelope. A first transverse line of perforations is positioned across the first portion of the first sheet above the fold line formed by the V-fold to form a first removable stub, and the remainder of the first portion below the first transverse line of perforations forms a flap for the integral return envelope. A second transverse line of perforations is positioned across the first portion of the second sheet, preferably along the fold line formed by the V-fold to form a second removable stub. The stubs may be printed to be receipts, invoices, or the like, which may be retained by the recipient or returned in the return envelope. An adhesive, such as a water remoistenable adhesive may be applied to the flap so that it can be sealed for mailing.

In another configuration of the mailer, the second portion of the first and second sheets are secured together parallel to a marginal side edge and both end edges inwardly of the lines of perforations defining the removable marginal side and end strips, while the remaining unsecured marginal side edge forms a flap for the integral return envelope. A first longitudinal line of perforations is positioned across the first portion of the first sheet forming a removable stub, and a second longitudinal line of perforations is positioned across the first portion of the second sheet forming a flap for closing the return envelope. Again, an adhesive may be applied to the flap so that it can be sealed for mailing.

In yet another embodiment of the invention, a mailer assembly is provided and includes first and second sheets in superimposed relation with each of the first and second sheets having a pair of marginal side edges and a pair of end edges. The first sheet includes a pattern of adhesive parallel to the marginal side and end edges on one surface thereof, and the second sheet includes a series of openings parallel to the marginal side and end edges thereof aligned with the pattern of adhesive on the first sheet. These openings may be of any suitable configuration such as circular holes, or square or rectangular openings.

The first and second sheets are temporarily secured together, as with crimps, along their respective marginal side and end edges to form a subassembly. The subassembly is V-folded and permanently secured together parallel to its marginal side and end edges by adhesive contact through the openings to form the mailer assembly. The openings may be aligned so that when folded, the openings match with one another so that an adhesive to adhesive bond is formed, or the openings may be aligned so that they are offset when folded to form adhesive to paper bonds. The mailer assembly further includes removable marginal side and end strips for opening the mailer assembly.

As with previous embodiments, the adhesive preferably is a heat sealable adhesive. Transverse and longitudinal lines of perforations positioned inwardly of the secured end and marginal side edges of the subassembly, respectively, are provided to form the removable marginal side and end strips. Again, the mailer may include a cut-out window area on the first sheet with an optional a transparent patch secured over the cut-out window area.

The mailer of the present invention is usually provided to a customer as separate continuous series of first and second sheets in intermediate form with nonvariable information preprinted thereon. The customer can then print his own variable information onto one or both sheets of the mailer and then assemble the sheets, fold them, and pass them through sealing equipment to form the finished mailer. The potential end uses for such a mailer are numerous and include, but are not limited to messages, advertisements, invoices, notices, bank statements, checks, money orders, and other negotiable instruments, and automobile titles and registrations. The mailer assembly of the present invention is adaptable for any of the many uses to which mailers in general have been put in the past.

Thus, a mailer assembly kit is provided in intermediate form which includes a first cover web having a series of spaced, transverse perforation lines to form individual cover sheets, and a second base web having a series of spaced, transverse perforation lines to form individual base sheets. Each of the cover and base sheets has substantially the same dimensions so that individual cover and base sheets may be associated one atop the other in a co-extensive relationship.

Each cover sheet includes a pair of marginal side edges and a pair of end edges, with transverse perforation lines positioned inwardly of the end edges and extending between the marginal side edges to form removable end strips and longitudinal perforation lines positioned inwardly of the marginal side edges and extending between the end edges to form removable marginal side strips. A pattern of a heat sealable adhesive is present on the back side of each of the cover sheets and is positioned outwardly of the longitudinal and transverse perforation lines. Each base sheet also includes a pair of marginal side edges and a pair of end edges, with transverse perforation lines positioned inwardly of the end edges and extending between the marginal side edges to form removable end strips and longitudinal perforation lines positioned inwardly of the marginal side edges and extending between the end edges to form removable marginal side strips. Again, a pattern of a heat sealable adhesive is present on a portion of the back side of each of the base sheets and is positioned outwardly of the longitudinal and transverse perforation lines and extends parallel to one of the end edges and substantially one-half the length of each of the marginal side edges.

The cover and base sheets are associated together in a superimposed relationship along their respective marginal and end edges to form a subassembly. The subassembly is heat sealable after V-folding along its marginal side and end strips from the pattern of adhesive on the back side of the cover sheet and from the pattern of adhesive on the back side of the base sheet to form the finished mailer. Preferably, heat sealing of all marginal strips takes place in a single step after folding of the subassembly.

The cover web may optionally include cut-out window areas on each of the cover sheets with transparent patches being secured over the cut-out window areas. The base sheets on the base web may be safety paper.

A mailer assembly kit which includes an integral return envelope may also be provided in intermediate form to a customer. That kit includes a first cover web having a series of spaced, transverse perforation lines to form individual cover sheets and a second base web having a series of spaced, transverse perforation lines to form individual base sheets. Each of the cover and base sheets has substantially the same dimensions so that individual cover and base sheets may be associated one atop the other in a co-extensive relationship.

Each cover sheet includes a pair of marginal side edges and a pair of end edges, with transverse perforation lines positioned inwardly of the end edges and extending between the marginal side edges to form,removable end strips and longitudinal perforation lines positioned inwardly of the marginal side edges and extending between the end edges to form removable marginal side strips. In this embodiment of the invention, a first pattern of a heat sealable adhesive is present on the back side of each of the cover sheets and extends along substantially one-half the length of each of the marginal strips and across the length of one of the end strips. This first pattern of adhesive is positioned outwardly of the longitudinal and transverse perforation lines. A second pattern of a heat sealable adhesive is present on the back side of each of the cover sheets and extends along substantially the other one-half the length of each of the marginal side strips and across the length of the opposite end strip. The second pattern of adhesive is positioned inwardly of the longitudinal and transverse perforation lines.

Each base sheet includes a pair of marginal side edges and a pair of end edges with transverse perforation lines positioned inwardly of the end edges and extending between the marginal side edges to form removable end strips and longitudinal perforation lines positioned inwardly of the marginal side edges and extending between the end edges to form removable marginal side strips. A pattern of a heat sealable adhesive is present on a portion of the back side of each of the base sheets and is positioned outwardly of the longitudinal and transverse perforation lines and extends along one of the end strips and substantially one-half the length of each of the marginal side strips.

The cover and base sheets are associated together in a superimposed relationship along their respective marginal side and end strips to form a subassembly with an integral return envelope. The subassembly is heat sealable after V-folding along its marginal and end edges from the first and second patterns of adhesive on the back side of the cover sheet and from the pattern of adhesive on the back side of the base sheet to form the finished mailer. As previously described, transverse lines of perforations are positioned across the cover sheets above the fold line formed by the V-fold and along the fold line of the base sheets to form removable stubs. The area on the cover sheets below the first transverse line of perforations forms a flap for the integral envelope, and an adhesive may be applied to the flap. The mailer may also include cut out window area with transparent patches on the covers sheets.

In yet another embodiment of the invention, a mailer assembly kit is provided to a customer in intermediate form in which the base web is adhesive free so that it can be passed through a laser printer. The construction of the cover and base webs is as previously described except that the base web has no adhesive, but rather includes a series of openings along the marginal side and end strips thereof. Once the subassembly of the cover and base sheets is formed and folded, the subassembly may be sealed into a finished mailer along its marginal side and end strips from adhesive contact of the pattern of adhesive through the openings in the base sheet.

Accordingly, it is an object of the present invention to provide a mailer assembly which can be supplied in intermediate form and which, when assembled and sealed, has an enhanced ability to shield confidential information from unauthorized view. It is a further object of the present invention to provide a mailer assembly which includes an integral return envelope. It is another object of the present invention to provide a mailer which is designed so that variable information can be printed on the sheets making up the mailer prior to assembly using nonimpact printers such as laser printers. These, and other objects and advantages of the present invention will become apparent from the following detailed description, the accompanying drawings, and the appended claims.

DETAILED DESCRIPTION OF THE PREFERRED EMBODIMENTS

Figure 1:
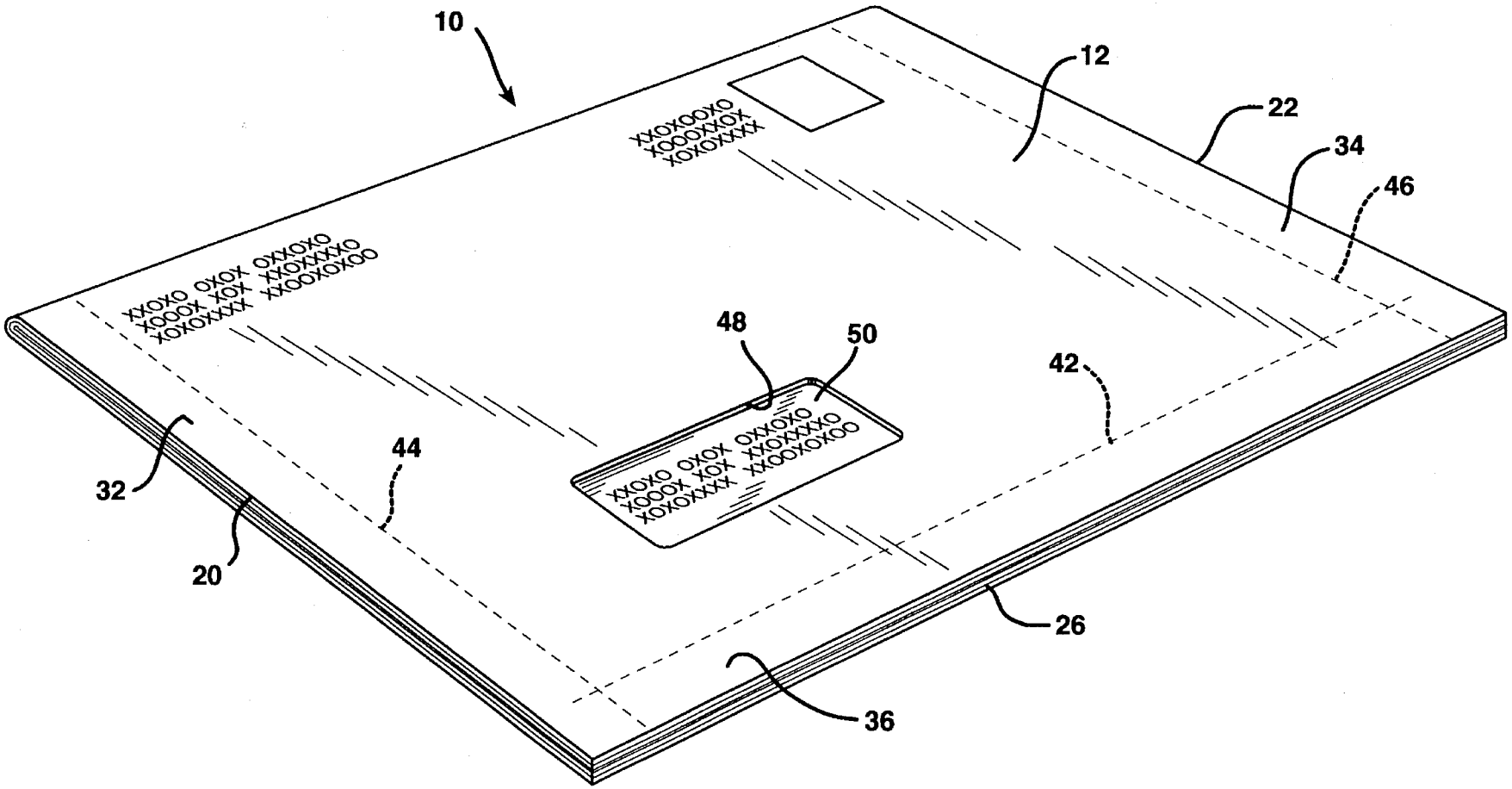
FIG. 1 is a perspective view of the sealed mailer of the present invention.
Figure 2:
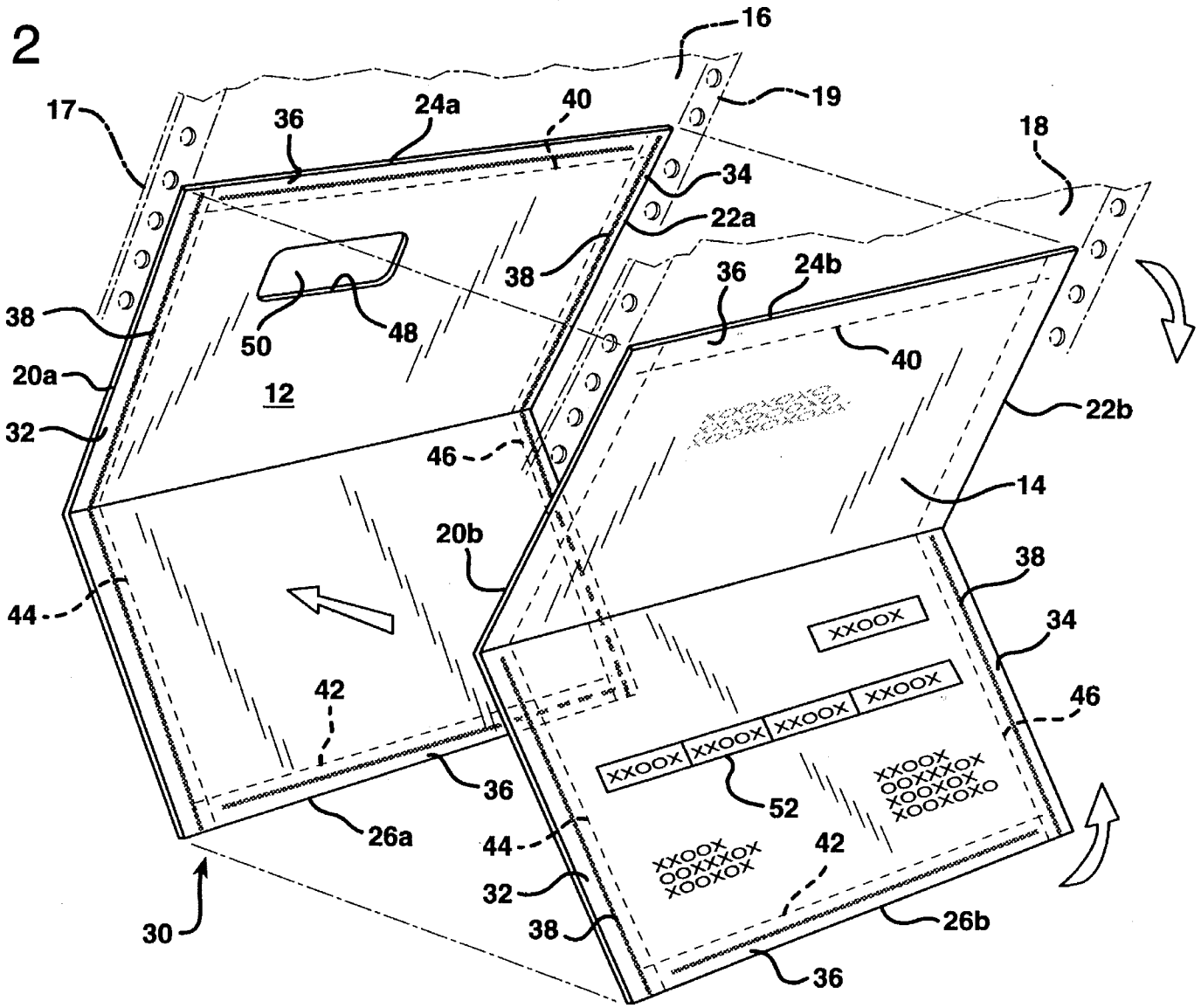
FIG. 2 is an exploded perspective view of the relationship of the cover and base sheets forming the mailer of the present invention.

Referring to FIGS. 1–2, a preferred construction of one embodiment of the mailer assembly of the present invention is illustrated. As shown, mailer assembly 10 includes first cover sheet 12 and second base sheet 14 which are of substantially the same dimensions and which are adapted to be placed in a superimposed relation one atop the other. A preferred means of supplying the cover and base sheets for the mailer is as continuous cover and base webs 16 and 18, respectively. Cover web 16 and base web 18 are only partially shown in phantom in FIG. 2 as their detail is not necessary to a complete understanding of the present invention. The webs are associated and aligned as is conventional in this art through the use of removable pin-hole feed strips 17, 19, respectively. A series of spaced transverse perforation lines across each of the webs is used to divide the webs into individual cover and base sheets.

Cover sheet 12 includes a pair of marginal side edges 20*a*, 22*a* and a pair of end edges 24*a*, 26*a*. Base sheet 14 also includes a corresponding pair of marginal side edges 20*b*, 22*b* and a pair of end edges 24*b*, 26*b*. Patterns of heat sealable adhesive 38 are applied to the back side (the side facing up in FIG. 2) of cover sheet 12 generally parallel to each of the marginal side and end edges 20–26. The adhesive patterns may comprise continuous or noncontinuous stripes or a series of spots. The adhesive patterns are positioned outwardly (i.e., toward the marginal and end edges) of longitudinal and transverse perforation lines 40–46 as shown. Other patterns of heat sealable adhesive 38 are applied on the lower half of the back side of base sheet 14 generally parallel to marginal side edges 20*b*, 22*b* and bottom end edge 26*b*. Again, the adhesive patterns are positioned outwardly of longitudinal and transverse perforation lines 40, 42, and 46 as shown.

Mailer assembly 10 may also be provided with a cut-out window area 48 on cover sheet 12. The window 48 is positioned on cover sheet 12 in any convenient location and is designed to mate with addressee information which has been printed on an interior surface of base sheet 14 so that information can be viewed for mailing purposes. As is conventional in the art, a transparent patch 50 of glassine or transparent polymer may be secured to cover window 48.

Typically, the mailer may be provided to a customer in a kit or intermediate uncollated form as rolls or stacks of continuous base and cover webs 16, 18. All nonvariable information may be preprinted onto the webs using conventional printing equipment, the window areas cut-out, and transparent window patches applied prior to shipment to a customer. Additionally, the patterns of heat sealable adhesive 38 are also preferably applied to the webs prior to customer shipment.

The customer may then use pin-hole feed marginal strips 17, 19 to guide the base and/or cover webs through his own printing equipment to add variable information to the front and/or back sides of those webs. Respective cover and base sheets on each web are then associated one with the other in a superimposed relationship with the back side of the cover sheets facing the front side of the base sheets as shown in FIG. 2 and their respective marginal side and end edges being in alignment. Again, pin-hole feed marginal strips 17, 19 may be used to obtain proper alignment.

Individual pairs of associated sheets 12, 14 are then torn from their respective webs in a conventional bursting operation to form subassembly 30. Pin-hole feed marginal strips 17, 19 may also be removed at this time either in a cutting or bursting operation. As the associated sheets travel through the bursting equipment, their respective marginal side strips parallel to edges 20, 22 may be temporarily secured, if needed. This securing of edges is preferably only temporary such as by passing subassembly 30 between a pair of knurled rollers or a crimping mechanism to form a temporary joinder at marginal side strips parallel to edges 20, 22.

The marginal strips are preferably permanently secured when the mailer is finished during a single pass through an integrated finishing line such as a Standard Register model 2000 Burster (available from the Standard Register Company, Dayton, Ohio), a Profold (trademark) folder, and a Standard Register model 410 Heat Sealer. As best shown in FIG. 2, subassembly 30 is V-folded in the direction shown by the arrows and then heat sealed to form the finished mailer. Cover sheet 12 and base sheet 14 are permanently secured to one another along marginal side strips parallel to edges 20*a–b*, 22*a–b* and end edges 24*a–b*, 26*a–b* by the adhesive on the back of cover sheet 12, and subassembly 30 is sealed to itself along marginal side strips parallel to edges 20*a–b*, 22*a–b* and end edge 26*a–b* by the adhesive on the back of the lower half of base sheet 14 to form the finished mailer assembly 10. While mailer assembly 10 may take many configurations, it is preferred that the base and cover sheets are of a size which, when folded in half, form a mailer which is of first class postage size. However, the invention is not limited to the specific configurations shown in the drawings and may be utilized for a number of different sized and shaped configurations.

Mailer assembly 10 is provided with removable marginal side strips 32 and 34 as well as a removable end strip 36. The removable strips are formed by providing the cover and base sheets with pairs of transverse lines of perforations 40, 42 and longitudinal lines of perforations 44, 46. The recipient of mailer assembly 10 may gain access to its contents by removing the strips 32–36 by folding and tearing them along the provided perforation lines.

As previously described, both nonvariable and variable information may be printed on any of the surfaces of the base, and cover sheets 12 and 14. Generally, cover sheet 12 will be preprinted with nonvariable information as it forms the exterior of the mailer. Base sheet 14, as shown in FIG. 2, may have its back side (upward facing side in FIG. 2) printed with both variable and nonvariable information, the variable information being supplied by the customer using his own printer. Because of the manner in which mailer assembly 10 is folded and sealed, the back side of base sheet 14 is quite secure from any unauthorized viewing against a light source. Its contents are completely sealed from outside view by the four-edge sealing of cover sheet 12 to base sheet 14 and the three edge sealing when the mailer assembly is folded and sealed. Accordingly, it is preferred that if the mailer is to contain confidential information, that the information be printed onto the back side of base sheet 14. The side of base sheet 14 facing cover sheet 12 may include any other desirable information including addressee information which aligns with window 48 when the mailer is folded and sealed.

Figure 3:
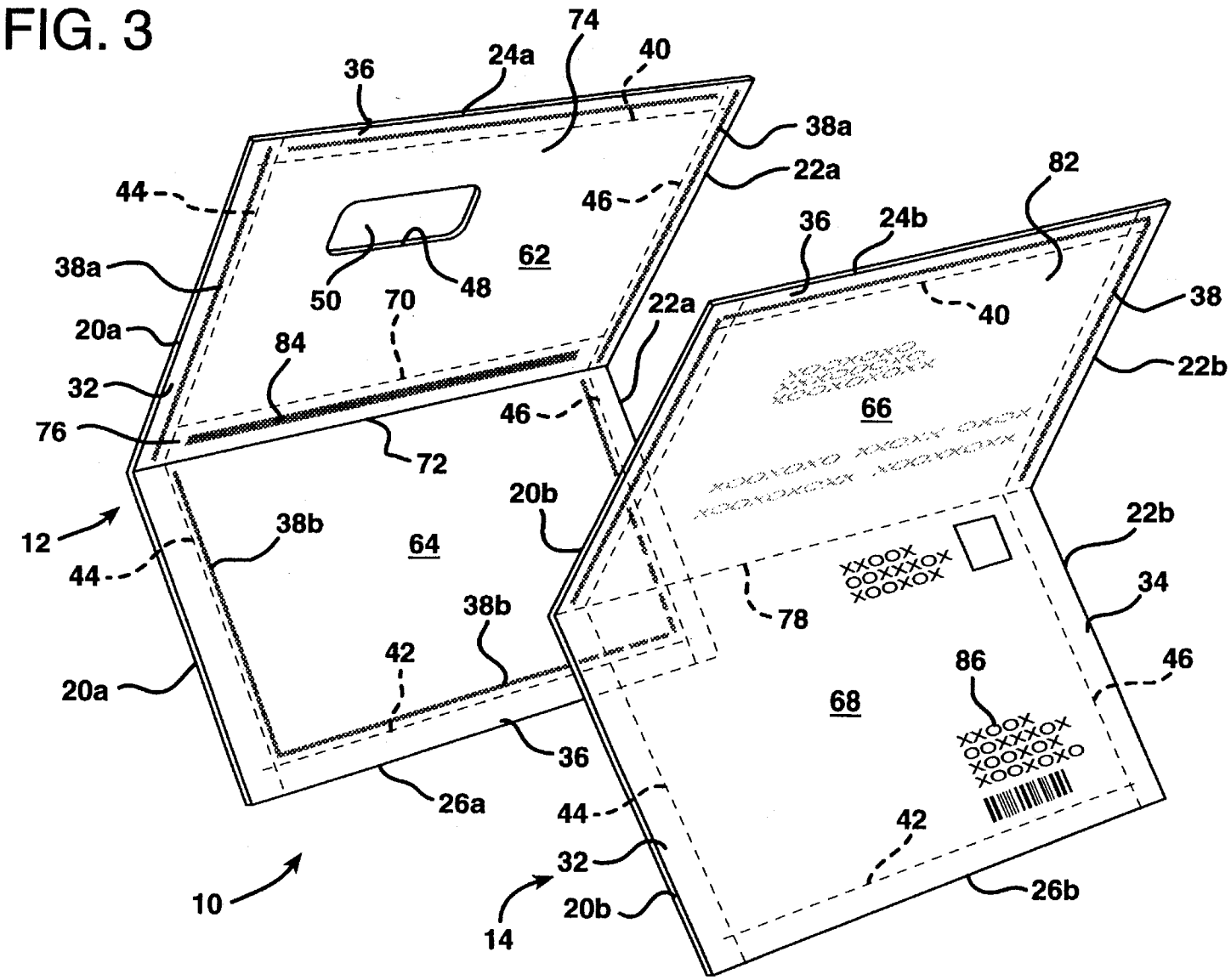
FIG. 3 is an exploded perspective view of the mailer of the present invention which includes an integral return envelope.
Figure 4:
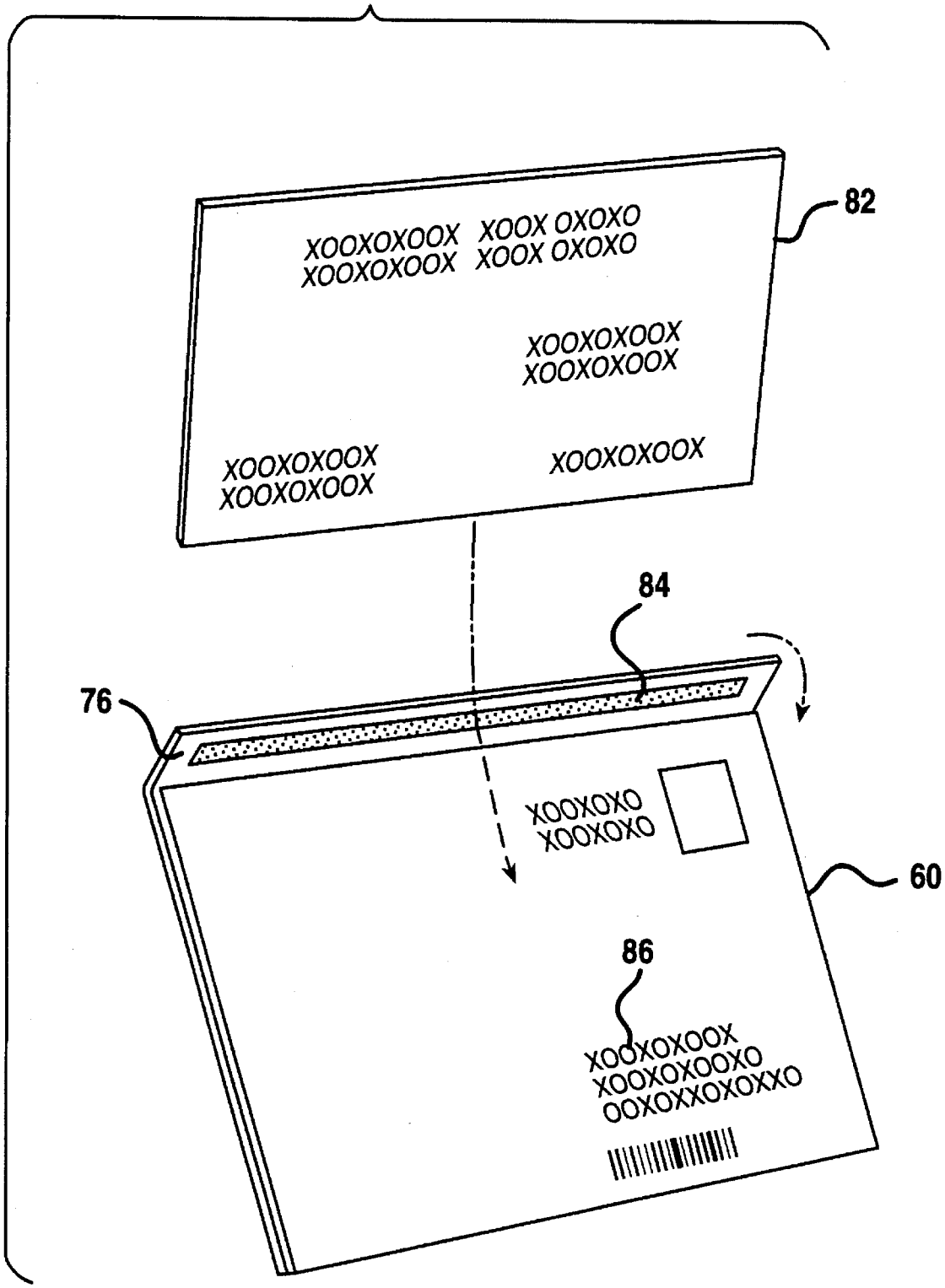
FIG. 4 is a perspective view of the return envelope portion of the mailer of FIG. 3 illustrating the placement of a return stub therein.

In another embodiment of the invention illustrated in FIGS. 3 and 4, where like elements are represented by like reference numerals, mailer assembly 10 includes an integral return envelope 60. In this embodiment, cover sheet 12 is divided roughly into two portions identified as areas 62 and 64. First portion 62 of cover sheet 12 is bounded by marginal side edges 20*a* and 22*a*, end edge 24*a*, and fold line 72. Second portion 64 is bounded by marginal side edges 20*a* and 22*a*, end edge 26*a*, and fold line 72.

Likewise, base sheet 14 is divided roughly into two portions identified as areas 66 and 68. First portion 66 of base sheet 14 is bounded by marginal side edges 20*b* and 22*b*, end edge 24*b*, and transverse perforation line 78 which is positioned along the fold line formed when the two sheets are V-folded together. Second portion 68 is bounded by marginal side edges 20*b* and 22*b*, end edge 26*b*, and transverse perforation line 78.

The respective first portions 62 of cover sheet 12 and 66 of base sheet 14 are secured together by adhesive 38*a* along their respective marginal side strips parallel to edges 20*a–b* and 22*a–b*, and end edge 24*a–b*, outwardly of their respective marginal perforation lines 40, 44, and 46. However, as best shown in FIG. 3, the respective second portions 64 of cover sheet 12 and 68 of base sheet 14 are secured together by adhesive 38*b* parallel to their respective marginal side edges 20*a–b* and 22*a–b*, and end edge 24*a–b*, inwardly of their respective marginal perforation lines 42, 44, and 46. This placement of adhesive patterns 38*a–b* results in the formation of an integral return envelope 60 by the secured together second portions 64 and 68. Placement of the adhesive pattern inwardly of the marginal perforation lines prevents removal of this securing means when the marginal strips are removed.

Placement of perforation line 70 above the fold line 72 produces both a flap 76 for envelope 60 as well as a first removable stub 74 which can be detached by a recipient of mailer assembly 10. Flap 76 preferably includes an adhesive 84 for sealing the return envelope. While different types of adhesive may be used, adhesive 84 is preferably a remoistenable adhesive. Likewise on second portion 66 of base sheet 14, the transverse line of perforations 78 produces a second removable stub 82 which can also be detached by the recipient of the mailer.

Either or both of stubs 74 and 82 can be printed to form receipts, invoices, or the like. One or both of the stubs may be designed to be returned by the recipient in the return envelope 60. As shown in FIGS. 3 and 4, portion 68 of base sheet 14 preferably also includes a preprinted return address 86 on what will become an exterior face of the return envelope 60.

Further, while the configuration of return envelope 60 shown in FIGS. 3 and 4 includes the flap along the top of return envelope 60, it will be appreciated by those skilled in this art that the adhesive patterns 38 may be reconfigured to produce a return envelope which is side opening with a flap on either end of the return envelope.

Figure 5:
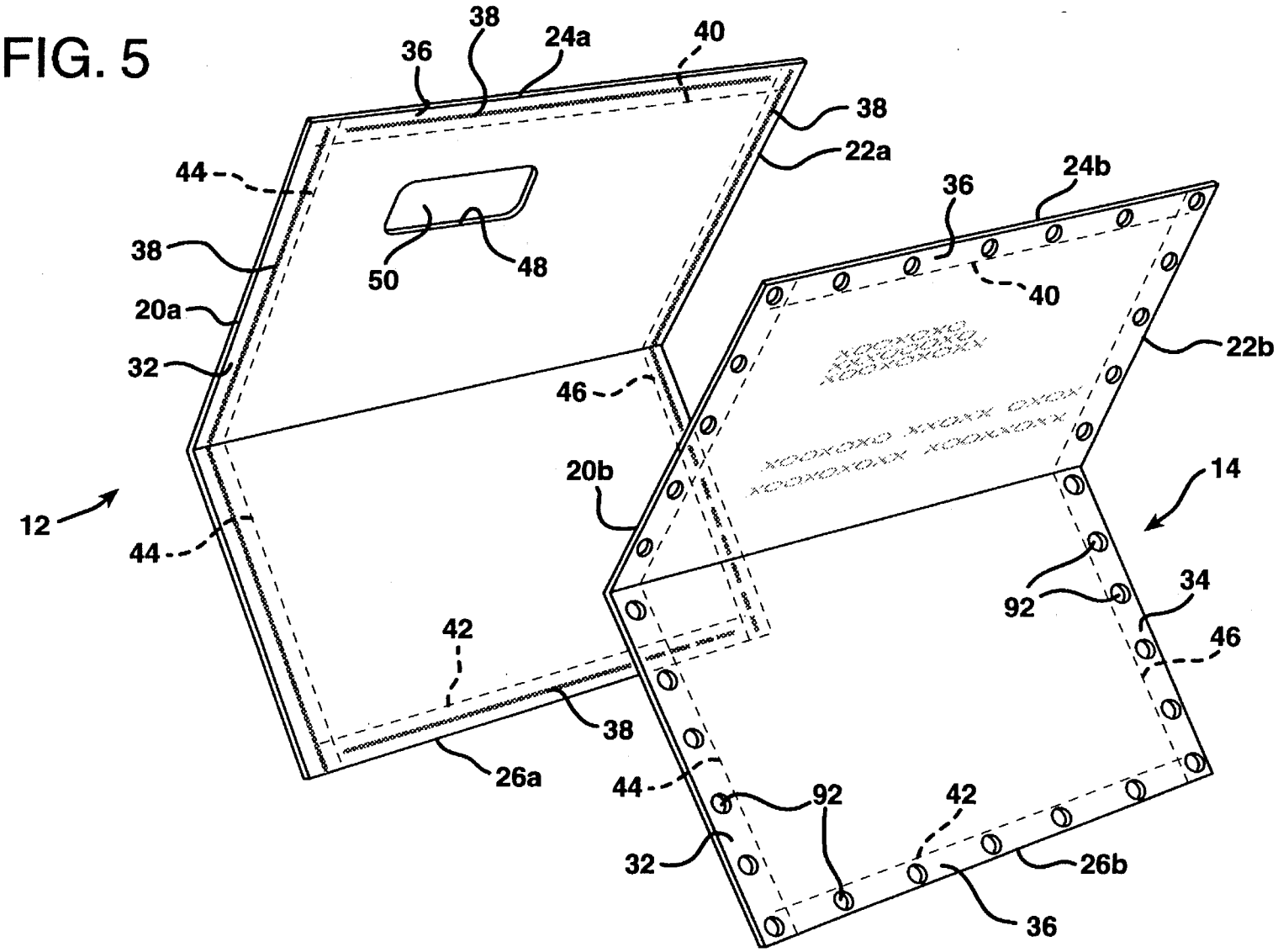
FIG. 5 is an exploded perspective view of another embodiment of the mailer of the present invention in which the base sheet has no adhesive.
Figure 6:
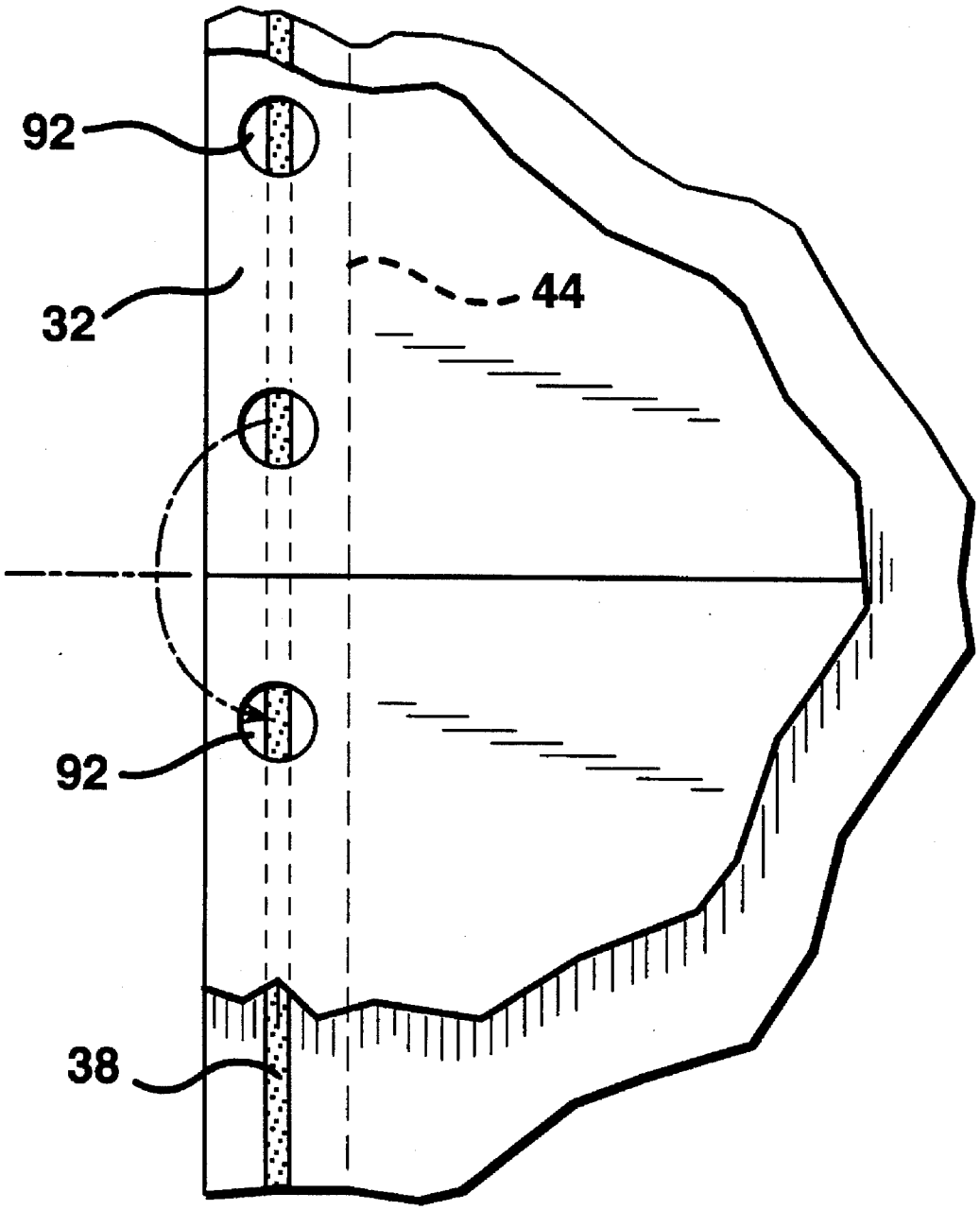
FIG. 6 is a partial plan view of the mailer of FIG. 5 illustrating the alignment of the pattern of adhesive on the top sheet with the cut out areas on the base sheet of the mailer.

Referring now to FIGS. 5 and 6, another embodiment of the invention is shown. Again, like elements are represented by like reference numerals. In this embodiment, base sheet 14 has no adhesive on it. This permits base sheet 14 (while still a part of base web 18) to be passed through a laser printer by a customer to add variable information to one or both sides of the sheet.

As shown in FIGS. 5 and 6, after printing is performed, base sheet 14 and cover sheet 12 are superimposed one atop the other and aligned along their respective marginal side edges 20*a–b* and 22 *a–b*, and end edges 24*a–b* and 26*a–b*. Cover sheet 12 includes patterns of heat sealable adhesive 38 on the back side thereof parallel to each of the marginal side and end edges 20*a*, 22*a*, 24*a*, and 26*a*. Again, the adhesive patterns are positioned outwardly of longitudinal and transverse perforation lines 40–46 as shown.

To provide a means to seal the mailer once the cover and base sheets have been associated and folded, a series of openings 92 are punched or cut into the marginal side and end strips 32–36 of base sheet 14. While the openings are illustrated as being circular in the drawing figures, it will be appreciated by those skilled in this art that the openings may assume other configurations such as square or rectangular openings. The purpose of openings 92 is to provide a series of places around the periphery of the mailer where, when the mailer is folded, adhesive 38 contacts either itself, as shown in FIG. 6, or a portion of the surface of the marginal and end strips 32–36. When the subassembly is folded and then passed through heated rolls to activate adhesive 38, a series of adhesive to adhesive, or adhesive to paper, seals are formed all along the periphery of the mailer.

While certain representative embodiments and details have been shown for purposes of illustrating the invention, it will be apparent to those skilled in the art that various changes in the methods and apparatus disclosed herein may be made without departing from the scope of the invention, which is defined in the appended claims.

What is claimed is:

1. A mailer assembly including an integral return envelope comprising first and second sheets in superimposed relation, each of said first and second sheets having lines of perforations defining a pair of removable end strips; each of said first and second sheets including a first portion and a second portion; said first portions of said first and second sheets being secured together parallel to their respective marginal side and end edges outwardly of said lines of perforations defining said removable marginal side and end strips, and said second portions of said first and second sheets being secured together parallel to both marginal side edges and at least one end edge inwardly of lines of perforations defining said removable marginal side and end strips, said secured together first and second sheets forming a subassembly, and the secured together second portions of said first and second sheets forming an integral return envelope; said subassembly being V-folded and secured together along its marginal side and end strips to form said mailer assembly, said mailer assembly including a first transverse line of perforations positioned across said first portion of said first sheet above the fold line formed by said V-fold forming a first removable stub, the remainder of said first portion below said first transverse line of perforations forming a flap for said integral envelope, said mailer assembly further including a second transverse line of perforations positioned across said first portion of said second sheet along the fold line formed by said V-fold forming a second removable stub; said mailer assembly including both variable and non-variable information printed on at least one interior surface of said first or second sheets and further including preprinted return address information on the exterior surface of said second sheet.

2. The mailer assembly of claim 1 in which an adhesive is applied to said flap.

* * * * *